US008348393B2

(12) United States Patent
Jilani et al.

(10) Patent No.: US 8,348,393 B2
(45) Date of Patent: Jan. 8, 2013

(54) PRINT HEAD DIAPHRAGM SUPPORT

(75) Inventors: Adel Jilani, Corvallis, OR (US); David Pidwerbecki, Corvallis, OR (US); Jun Zeng, Corvallis, OR (US); Hui Liu, Corvallis, OR (US); James R. Przybyla, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 154 days.

(21) Appl. No.: 12/867,266

(22) PCT Filed: Mar. 17, 2008

(86) PCT No.: PCT/US2008/057287

§ 371 (c)(1),
(2), (4) Date: Aug. 12, 2010

(87) PCT Pub. No.: WO2009/116993

PCT Pub. Date: Sep. 24, 2009

(65) Prior Publication Data

US 2010/0309259 A1 Dec. 9, 2010

(51) Int. Cl.
*B41J 2/045* (2006.01)

(52) U.S. Cl. ..... 347/68

(58) Field of Classification Search ..... 347/54, 347/68, 70–72

See application file for complete search history.

(56) References Cited

U.S. PATENT DOCUMENTS

| | | | | |
|---|---|---|---|---|
| 5,752,303 | A | 5/1998 | Thiel | |
| 6,164,759 | A | 12/2000 | Fujii et al. | |
| 6,176,570 | B1 | 1/2001 | Kishima et al. | |
| 6,286,925 | B1 | 9/2001 | Heinzl et al. | |
| 6,505,915 | B2 | 1/2003 | Asakawa et al. | |
| 6,811,248 | B2 * | 11/2004 | Matsuo et al. | 347/68 |
| 2002/0024567 | A1 | 2/2002 | Takagi | |
| 2005/0001885 | A1 | 1/2005 | Isono et al. | |
| 2005/0212863 | A1 | 9/2005 | Sanada | |
| 2008/0043069 | A1 | 2/2008 | Shimada et al. | |

FOREIGN PATENT DOCUMENTS

| | | |
|---|---|---|
| EP | 1693206 A1 | 8/2006 |
| JP | 200094687 | 4/2000 |

OTHER PUBLICATIONS

Supplementary European Search Report for Application No. EPO08732383, Report issued Aug. 10, 2011.

* cited by examiner

*Primary Examiner* — An Do

(57) ABSTRACT

A print head (20, 220) includes a diaphragm (26) opposite a fluid chamber (21) having a side opening, a first end and a second end. The print head (20, 220) further includes a support (30, 32, 300, 302, 310, 312, 320, 322) extending from a floor (52) of the fluid chamber (21) to the diaphragm (26).

19 Claims, 6 Drawing Sheets

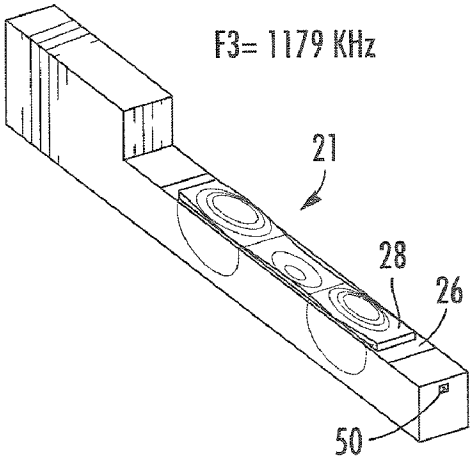
FIG. 7
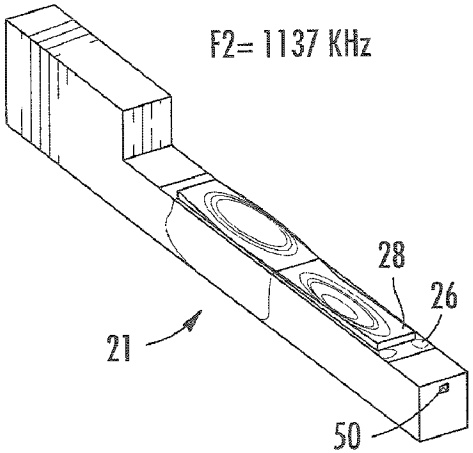
FIG. 8
FIG. 9
F3-F1
70 KHz
40 KHZ (DEFAULT)

PRINT HEAD DIAPHRAGM SUPPORT

CROSS-REFERENCE TO RELATED PATENT APPLICATIONS

The present application claims priority from PCT/US 2008/057287 filed on Mar. 17, 2008.

BACKGROUND

Some print heads actuate or apply force to a diaphragm to eject fluid through one or more nozzles. When ejecting fluid at higher frequencies, trajectory or other ejection errors may result, reducing print quality.

BRIEF DESCRIPTION OF THE DRAWINGS

FIGS. 7-9 are perspective views of the fluid ejector of FIG. 1 illustrating frequency modes of a diaphragm of the fluid ejector according to an example embodiment.

DETAILED DESCRIPTION OF THE EXAMPLE EMBODIMENTS

Figure 3:
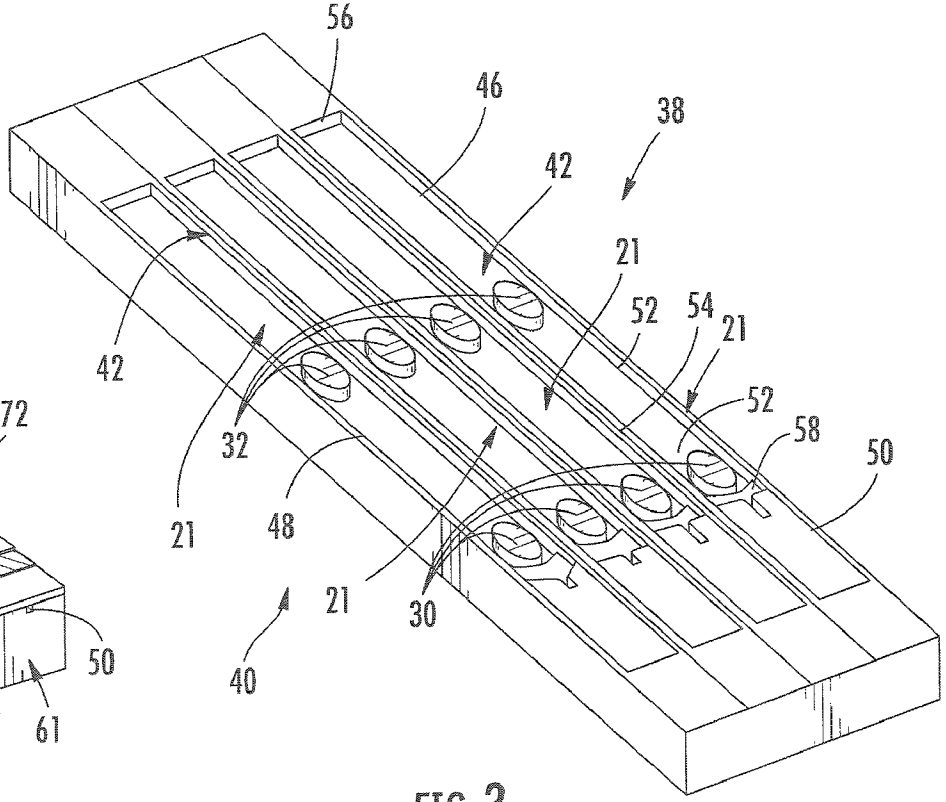
FIG. 3 is a top perspective view of a substrate of the print head of FIG. 1 according to example embodiment.
Figure 1:
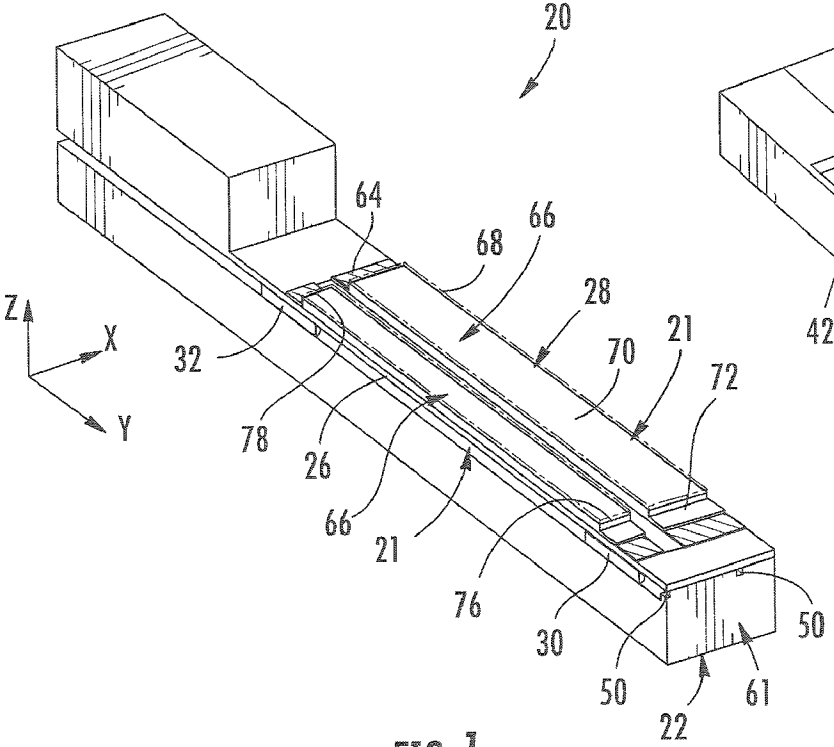
FIG. 1 is a fragmentary perspective view of a print head illustrating a fluid ejector in section according to an example embodiment.
Figure 2:
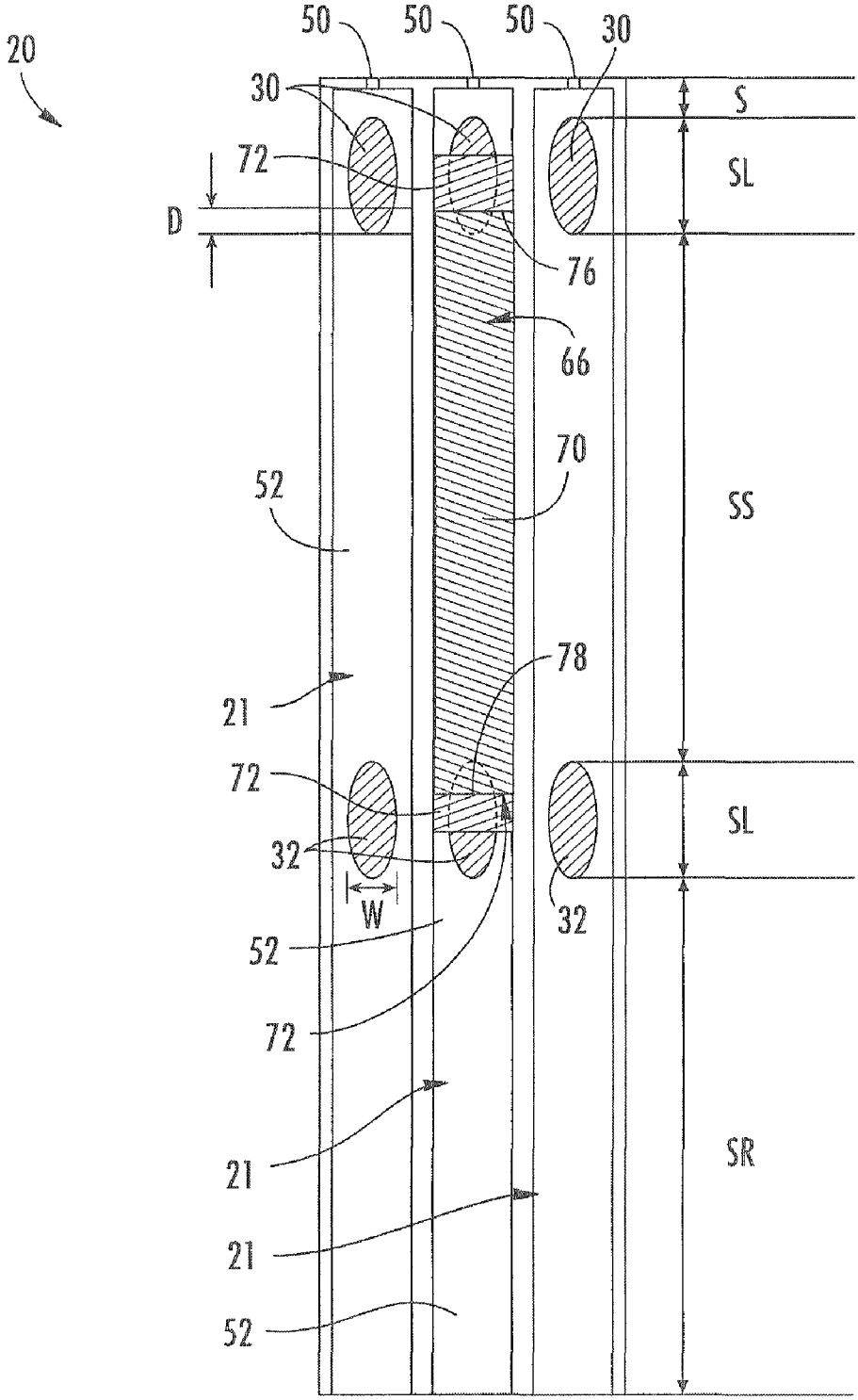
FIG. 2 is a top plan view of the print head of FIG. 1 with portions omitted for purposes of illustration according to an example embodiment.

FIGS. 1-3 illustrate inkjet print head 20 according to an example embodiment. Print head 20 is configured to selectively dispense or eject one or more fluids, such as one or more inks, onto a medium. As will be described hereafter, print head 20 ejects fluid at a higher frequency with greater accuracy. Print head 20 includes one or more fluid ejectors 21. Each fluid ejector 21 includes substrate die or substrate 22, diaphragm 26, actuators 28 and supports 30, 32.

As shown by FIG. 3, which illustrates three substantial identical side-by-side fluid ejectors 21, substrate 22 comprises a substantially planar structure formed from one or more layers of one more materials having opposite faces 38, 40. Face 38 includes multiple fluidic features or channels 42, with one channel 42 provided for each fluid ejector 21. Each channel 42 includes a fill chamber or portion 46, an ejection chamber or portion 48 and one or more nozzle openings 50. Fill portions 46 comprises those portions of channels 42 which are in direct fluid communication with the fluid supply our source, such as a fluid reservoir (not shown) the ejection portions 48 comprise those portions of channels 42 generally proximate to actuator 36 and terminating at nozzle openings 24.

Each of channels 42 is formed by one or more structures and has a floor 52, transverse sidewalls or sides 54 and longitudinal ends 56, 58. End 56 is located adjacent to fill chamber or portion 46 while longitudinal end 58 is located adjacent to or proximate the ejection chamber or portion 48 and nozzle openings 50. FIG. 3 illustrates substrate 22 prior to severing of an end portion of substrate 22 to expose or open nozzle openings 50.

Nozzle openings 50 comprise orifices along a nozzle edge 61 of substrate 22 (shown in FIG. 1) through which fluid is ejected. Nozzle openings 50 have controlled and defined dimensions to regulate a volume of fluid ejected. Ejection portions 52 may also have a defined geometry to assist in regulating the amount of fluid ejected through openings 50. For example, ejection portion 48 defines a volume. Movement of diaphragm 26 by an adjacent actuator 36 changes the volume to eject fluid through a corresponding opening 50.

According to one example embodiment, substrate 22 is formed from a homogenous layer of silicon into which channels 42 and openings 50 are fabricated using photolithography, etching and/or other fabrication techniques. According to yet another example embodiment, substrate 22 may be formed from a homogenous layer of one or more polymeric materials into which channels 42 and openings 50 are fabricated. In one embodiment, the one or more polymeric materials may comprise thermoset polymeric materials, such as epoxy. In yet other embodiments, one or more polymeric materials may comprise a thermoplastic polymeric material, such as polyetherimide (PEI). In those embodiments in which substrate 22 is formed from a thermoplastic material, substrate 22 made exhibit enhanced ink resistance and rigidity.

Examples of low-cost high modulus polymeric materials from which substrate 22 may be injection molded include Examples of low-cost high modulus polymeric materials from which substrate 22 may be injection molded include liquid crystal polymers (LCP), polysulfone (PS) and Polyether-ether-ketone (PEEK). Other examples of polymeric materials from which substrate 22 may be molded include: polyethylenteraphalate (PET), polyethyleneimine (PEI), Polyphenylene sulfide, (PPS) and polyisoprene (PI). In yet other embodiments, substrate 22 may be impression molded. Use of polymers to form substrate 22 may reduce the cost of print head 20, enable a wider format of print heads by avoiding or reducing silicon-based processing and harnessing improved mechanical properties of polymers such a strain to failure, facilitate rapid turn-around prototyping, and increase the degrees of freedom for fluidic architecture of channels 32.

In some embodiments, the polymeric material forming substrate 22 may additionally include a percentage of filler material. Examples of filler material include, but are not limited to, carbon, titania, metal, and glass. In those embodiments in which the polymeric material includes a filler material, substrates 22 may exhibit increased rigidity and thermal conductivity.

In one embodiment, channels 42 and openings 50 are molded into substrate 22. For example, in one embodiment, substrate 22 is injection molded. Use of injection molding facilitates varied geometries for openings 50 which may provide benefits with regard to fluid drop uniformity and/or directionality. In still other embodiments, channels 42 may be formed in substrate 22 in other fashions such as by one or more material removal techniques such as photolithography or photopatterning and etching, electromechanical machining, such as cutting, sawing, grinding and the like, or laser ablation or cutting.

As shown by FIG. 1, diaphragm 26 comprises one or more layers of one or more materials formed from selected materials and dimensioned so as to be sufficiently flexible to permit actuator 28 to flex or bend diaphragm 26 towards floor 52 so as to change the volume of ejection portion 48 of channels 42. In one embodiment, diaphragm 26 is formed from a continuous layer that extends over both fill portions 46 and ejection portions 48, wherein the layer is much thinner opposite to ejection portion 36 permits such flexing while those portions of the layer opposite to fill portions 46 are substantially inflexible.

In one embodiment, diaphragm 26 is formed from a glass layer having a thickness of about 58 μm. Such thin glass sheets are commercially available from vendors such as Schott. North America, Inc. of Elmsford, N.Y. According to one embodiment, diaphragm 26, formed from such a glass material, has a mechanical modulus of about 60 GPa and a Poisson's Ratio of about 0.25. Diaphragm 26 has a coefficient of thermal expansion of between about 3 and about 9 ppm. In other embodiments, diaphragm 26, formed from such a glass material, may have other dimensions. In still other embodiments, diaphragm 26 may be formed from other materials.

Actuators 28 comprise mechanisms or devices configured to selectively and/or flex portions of diaphragm 26 opposite to one or more of channels 42 so as to change the internal volume of ejection portions 48 to force fluid out of channels 42 through nozzle openings 50. In the example embodiment illustrated, actuators 28 comprise piezo electric or piezo resistive actuators, wherein piezo electric element deforms, flexes or changes shape in response to an applied electrical potential or voltage. As shown by FIG. 1, in the example illustrated, actuators 28 each comprise electrical conductor 64, piezo element 66 and electrical conductors 68.

Electrical conductors 64 comprise one or more electrically conductive structures or layers supported by diaphragm 26 and in contact with an associated piezo element 66. Electrical conductors 64 assist in forming an electrical potential across piezo elements 66, facilitating ejection of fluid through openings 50. In one embodiment, electrical conductors 64 comprise a metal composite upon diaphragm 26. For example, in one embodiment, electrical conductors 64 comprise sputtered indium tin oxide (ITO) having a thickness of about 02 μm. In other embodiments, conductors 64 may comprise other electrically conductive materials and may have other dimensions. Electrical conductors 64 may also be joined to diaphragm 26 in other fashions or merely extend adjacent to diaphragm 26.

Piezo element 66 comprise patches or bands of piezo material. In one embodiment, piezo elements comprise piezo electric ceramic or piezo electric crystals which, when subjected to an externally applied voltage, change shape by a small amount. Examples of piezo materials include, but are not limited to, lead zirconate titanate (PZT). In other embodiments, piezo elements 66 maybes comprise other piezo ceramics or crystals.

As further shown by FIG. 1, each piezo element 66 is electrically isolated from an adjacent band or element 66 and corresponds to an opposite ejection portion 48 of a particular channel 42. Each piezo element 66 is electrically connected to one or more power sources by electrical conductors 68, enabling individual elements 66 to be charged two distinct voltages.

In the example illustrated, piezo elements are formed by sputtering the piezo material, such as PZT, to form a thick layer 70 of piezo material upon the conductors 64 and then removing a substantial thickness of portions of the layer to define the length and bounds of the piezo elements. The thinner portions 72 of the piezo material layer are so thin that they do not effectively function as the part of the piezo elements.

Electrical conductors 68 comprise the one or more electrically conductive structures in electrical contact with piezo elements 66 and configured to cooperate with electrical conductor 64 to apply a voltage across piezo element 66. Electrical conductors 68 enable distinct voltages to be applied across different element 66. As a result, fluid may be independently ejected through individual openings 50 to form a pattern or image of fluid upon a surface being printed upon. In one embodiment, electrical conductors 66 comprise a sputtered electrical he conductive material, such as gold or indium tin oxide, patterned onto element 66. In other embodiments, electrical conductors 66 may comprise other configurations or geometries of other electrically conductive materials.

Supports 30, 32 in each comprise structures extending between floor 52 on an underside of diaphragm 26 overlapping or along the effective edges 76, 78 of piezo element 66. As shown by FIGS. 1 and 2, support 30 comprises a post, column or other structure extending from floor 52 within each channel 42 generally opposite to opposite effective longitudinal ends 72 (the ends of the thicker portions 70 of the piezo material) of piezo elements 66. Supports 30, 32 serve to support or inhibit flexing of selected portions of diaphragm 26 along channel 26 to enhance performance of print head 20. In particular, as will be described in more detail thereafter, supports 30, 32 increase the separation or disparity between natural modal frequencies of diaphragm 26 without substantially sacrificing pumping efficiency. Because the disparity between natural modal frequencies of diaphragm 26 is increased, actuators 28 may be actuated or "fired" at a faster frequency without corresponding trajectory or other fluid ejection errors that otherwise might exist due to the natural modal frequency disparity being too close to the firing frequency.

In addition to supporting diaphragm 26 along or opposite to edges or ends 78 of piezo element 66, support 32 further serves as a restrictor. In particular, support 32 inhibits flow of fluid out of ejection portion 48 towards fill portion 46. As a result, fluid is more likely to flow in the opposite direction out of ejection portion 48 towards nozzle 50.

FIG. 2 illustrates one example. As shown by FIG. 2, supports 30, 32 have substantially the same shape and the same dimensions. Supports 30, 32 each have a substantially oval-shape. Because supports 30, 32 are oval in shape, supports 30, 32 may extend across or overlap edges 76, 78 of the overlying piezo element 66 while obstructing fluid flow past supports 30, 32 to a lesser extent. Supports 30, 32 are integrally formed as part of a single unitary body with substrate 22. Diaphragm 26 is formed from glass and is anodically bonded to supports 30, 32. Because supports 30, 32 are connected to diaphragm 26, diaphragm 26 may be formed from a relatively brittle material such as glass.

In other embodiments, supports 30, 32 may have different shapes and dimensions. In other embodiments, supports 30, 32, substrate 22 and diaphragm 26 may be formed from other materials. In other embodiment, supports 30, 32 may be connected to diaphragm 26 in other fashions, such as by one or more adhesives. In still other embodiments, supports 30, 32 may not be connected to diaphragm 26 but may extend into close proximity to diaphragm 26.

FIG. 2 further illustrates dimensions of one example print head 20 with fluid ejectors 21. In the example illustrated, each of supports 30, 32 has a support length SL approximately 600μ and projects beneath piezo element 66 by a distance D of approximately 150μ. Each support 30, 32 has a width W of about 250μ. Supports 30 are spaced from novels 50 by a distance S of about turned 75μ. Support 32 is based from a rear of fill chamber 46 by a distance SR of about 2650μ. Support 32 is spaced from support 30 by a distance SS of about 2645μ. The thick effective portion of piezo element 66 has a length of approximately 3000μ. Thin portions 72 each have a length of about 300μ. In other embodiments, supports 30, 32, piezo element 66 and others structures of the print head may have different dimensions, different shapes and different relative spacings.

Figure 4:
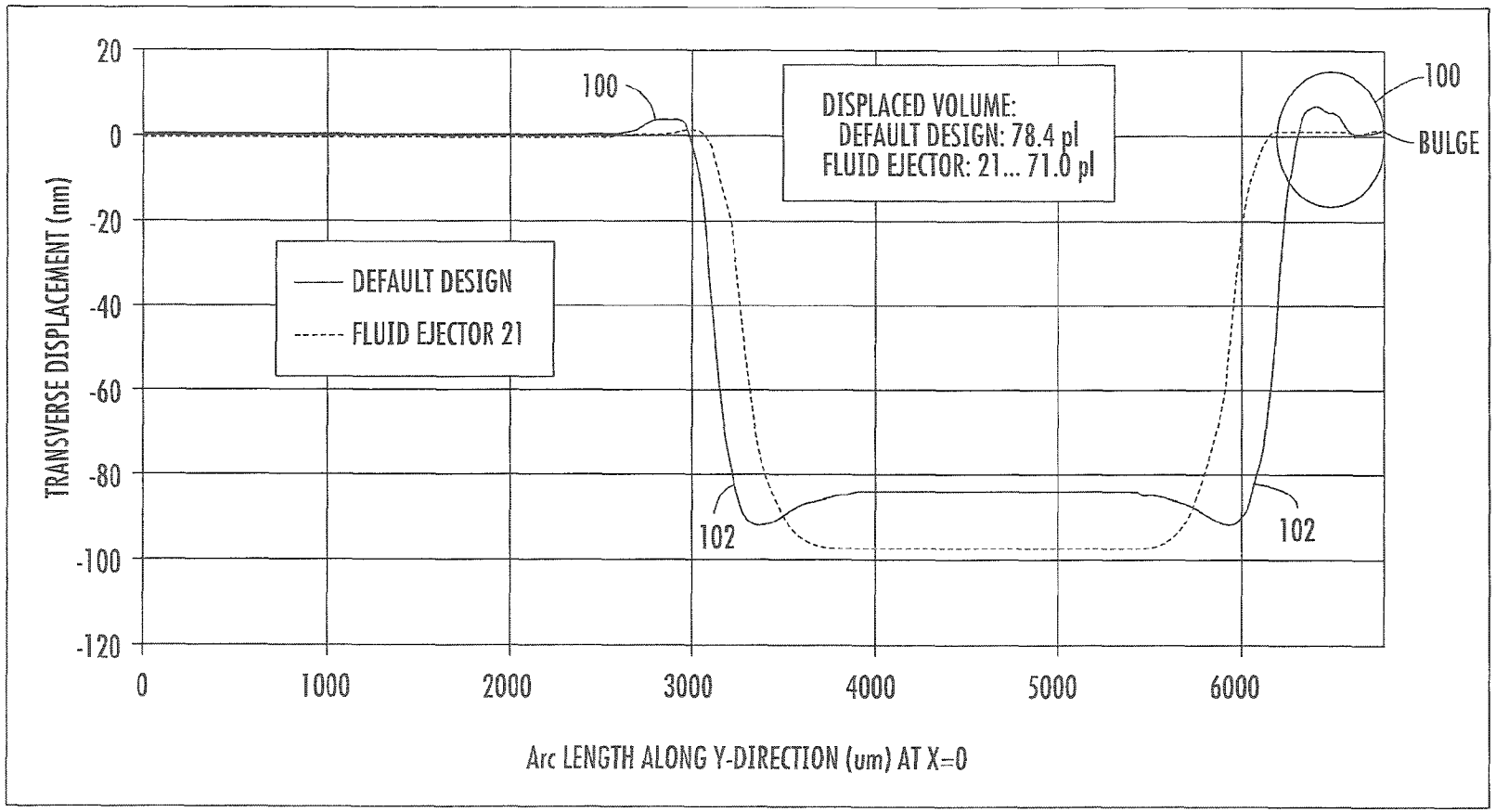
FIG. 4 is a graph comparing displaced volume of the fluid ejector of FIG. 1 to fluid ejector without supports according to an example embodiment.
Figure 5:
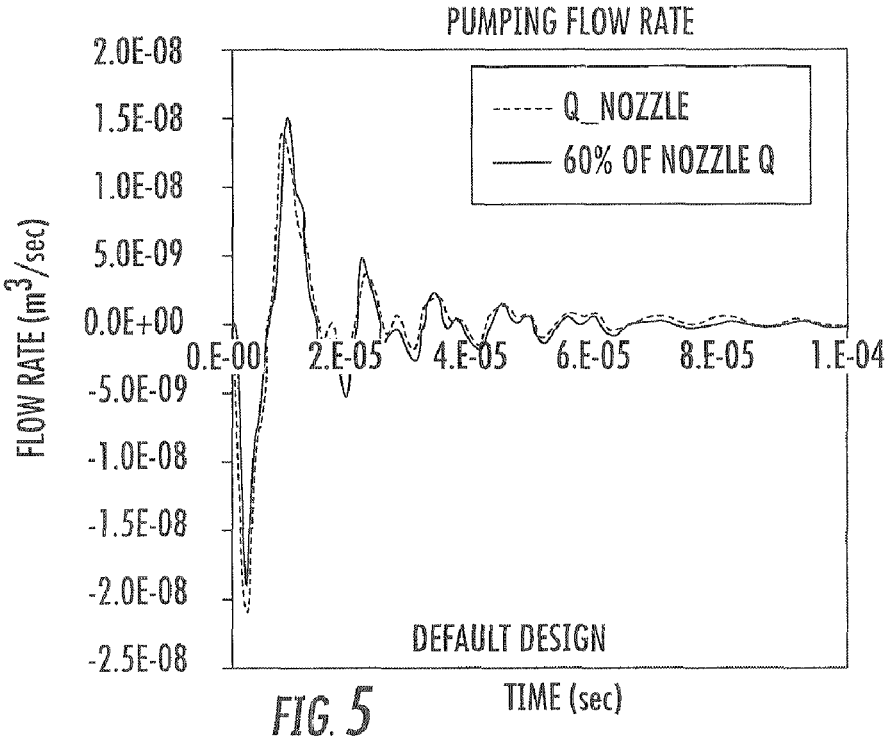
FIG. 5 is a graph a flow rates of the fluid ejector of FIG. 1 without supports.
Figure 6:
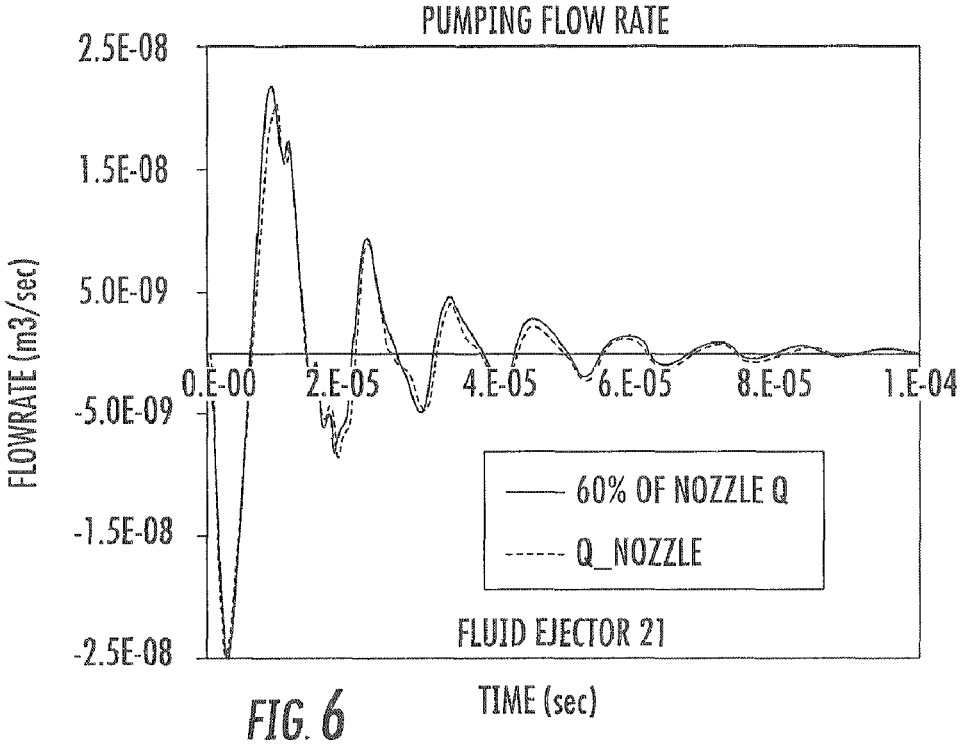
FIG. 6 is a graph of flow rates of the fluid ejector of FIG. 1 with supports according to an example embodiment.

FIGS. 4-9 illustrate performance of one of fluid ejectors 21 having the above noted example dimensions and formed from the above noted materials. FIG. 4 compares displaced volume of fluid by diaphragm 26 by print head 20 having post 30, 32 to displaced volume of fluid by diaphragm 26 by another print head (the "default design") identical to print head 20 in all respects but without supports 30, 32. As shown by FIG. 4, support posts 30, 32 reduce or eliminate bulges or spikes 100, 102 in the deformation or displacement of diaphragm 26. Such spikes 100, 102 may otherwise decrease the natural modal frequency disparity of diaphragm 26. In addition, by reducing or eliminating such spikes 100, 102, the shape of diaphragm 26 during deformation is more like a piston. As a result, diaphragm 26 is actuated with greater force to provide a greater drop velocity or flow rate as indicated by FIGS. 5 and 6. Although print head 20 having supports 30, 32 may have a reduced displaced volume (71.0 pl for print head 20 as compared to 78.4 pl for the "default design"), the increased flow rate substantially compensates for the reduced displaced volume. As a result, print head 20 having the additional support post 30, 32 does not experience a substantial reduction in pumping efficiency.

FIGS. 7-9 illustrate the three main modes of diaphragm 26 in response to actuation of actuator 28. FIG. 7 illustrates diaphragm 26 in a first mode. FIG. 8 illustrates diaphragm 26 in a second mode. FIG. 9 illustrates diaphragm 26 in a third mode. In the example illustrated, the first mode and the second mode have a frequency difference or disparity of about 65 KHz. In contrast, the "default design" without supports 30, 32 has a frequency difference or disparity between the first mode and the third mode of about 40 KHz. By increasing the natural modal frequency disparity between the first mode and the third mode of diaphragm 26, support posts 30, 32 facilitate the firing of actuators 26 at a faster frequency, near or below 40 kHz, with reduced likelihood of fluid ejection errors that might other wise exist if the natural frequency modal disparity were closer to the firing frequency.

Figure 10:
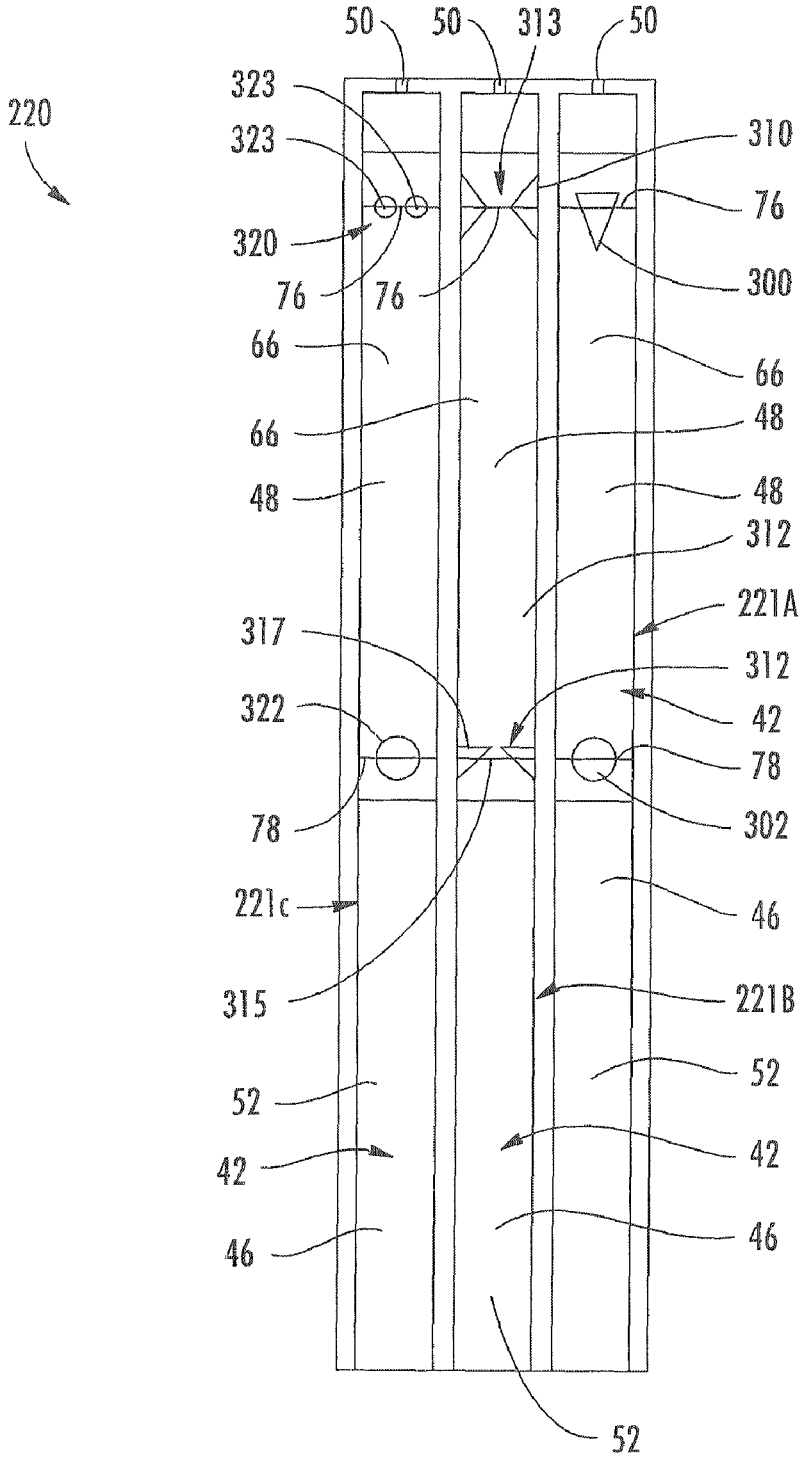
FIG. 10 is a top plan view of another embodiment of the print head of FIG. 2 according to example embodiment.

As noted above, print head 20 is but one example embodiment. Similar benefits may be achieved with other embodiments having different dimensions and configurations. FIG. 10 illustrates a print head 220, another embodiment of print head 20. Print head 220 is similar to print head 20 accept that print head 220 includes fluid ejectors 221A, 221B and 221C (collectively referred to as fluid ejectors 221) in lieu of fluid ejectors 21. Fluid ejectors 221 are similar to fluid ejectors 21 except that fluid ejectors 221 include different combinations of supports in place of supports 30, 32. Those remaining elements of print head 220 and fluid ejectors 221 which correspond to elements of print head 20 and fluid ejectors 21 are numbered similarly.

Fluid ejectors 221A is similar to fluid ejector 21 except that fluid ejector 221A as differently shaped supports at opposite ends of the ejection portion 48 of its channel 42. In particular, the ejector 221A includes supports 300 and 302 in place of supports 30 and 32, respectively. Support 300 is generally triangular shaped with its tip pointing towards support 302. Support 300 is centrally located within the channel 42 to fluid my flow around opposite sides of support 300. Support 300 is arranged such that its wider base underlies edge 78 of piezo element 66.

Support 302 is generally circular in shape. Support 302 is centrally located within channel 42 such a fluid flows around opposite side to support 302. Support 302 is located such that edge 78 of piezo element 66 intercepts a center point of support 302. In one embodiment, support 302 occupies a greater transverse width of channel 42 as compared to support 300, enhancing its ability to serve as a restrictor inhibiting reverse flow of fluid from ejection portion 48 of channel 42.

Fluid ejector 221B is similar to fluid ejector 21 except that fluid ejector 221B includes supports 310 and 312 in place of supports 30 and 32, respectively. As shown by FIG. 10, supports 310 comprise structures projecting from opposite sides of channels 21 towards one another. Supports 310 extend below diaphragm 26 and opposite to edge 76 of piezo element 66. As a result, supports 310 form a central opening 313 between supports 310 in more alignment with nozzle openings 50. Although each of supports 310 is illustrated as being triangular in shape, in other embodiments, each of supports 310 may alternatively be semi-oval, semicircular or rectangular in shape. Triangular shapes, semi-oval shapes or semicircular shapes may provide enhanced fluid flow through opening 313 as compared to a rectangular or square shape.

Supports 312 comprised structures projecting from opposite transverse sides of channel 42 towards one another so as to form an intermediate channel or opening 315. Supports 312 extend between the floor of channel 42 and diaphragm 26 opposite to and partially along edge 78 of piezo element 66. According to one example embodiment, supports 312 are dimensioned or shaped such that opening 315 is smaller than opening 313, enhancing the ability of supports 312 to additionally serve as a restrictor, inhibiting reverse flow fluid from ejection from chamber or portion 48.

Although each of supports 312 is illustrated as being triangular in shape, in other embodiments, supports 312 may alternatively be semi-oval, semicircular or rectangular in shape. Supports 312 may have different shapes from that of supports 310. For example, in one embodiment, supports 310 may be semi-oval, semicircular or triangular in shape to enhance fluid flow while supports 312 may be rectangular in shape or may have less gradual faces (faces more perpendicular to the longitudinal direction of channel 42), such as faces 317 towards ejection portion 48, to better restrict reverse fluid flow out of ejection portion 48.

Fluid ejector 221C is similar to fluid ejector 21 except that fluid ejector 221C includes supports 320 and 322 in place of supports 30 and 32, respectively. Supports 320 comprise multiple structures projecting from the floor 52 of channel 42 towards diaphragm 26 and either connected to or in contact with diaphragm 26. As shown by FIG. 10, sports 320 are spaced from sidewalls of channel 42 and are also spaced from one another. Supports 320 are located opposite to and along edge 76 of piezo element 66. Supports 320 permit fluid flow paths and around supports 320. At the same time, supports 320 traditionally serve to filter contaminants or particles larger than the spacing or gaps between the individual columns or posts of supports 320. Although supports 320 are illustrated as comprising columns or posts 323 having circular cross-sections, and other bombers, such columns or posts of supports the role 320 may have other cross-sectional shapes. Although supports 320 are illustrated as including two spaced columns or posts 323, in other embodiments, supports 320 may include greater than two of such columns or posts 323.

Support 322 extends between the floor 52 of channel 42 and diaphragm 26. Support 322 further extends below, opposite to or less partially along edge 78 of piezo element 66. Support 322 is centrally located within channel 42 to facilitate fluid flow about and around support 322.

In other embodiments, support 322 may have other configurations. For example, in other embodiments, support 322 may alternatively be configured similarly to supports 312.

Support 310 may alternatively be configured similar to supports 300 or 310 as well. Like supports 30 and 32, each of supports 300, 302, 310, 312, 320 and 322 serve to support or inhibit flexing of selected portions of diaphragm 26 along channel 26 to enhance performance of print head 20. Supports 300, 302, 310, 312, 320 and 322 increase the separation or disparity between natural modal frequencies of diaphragm 26 without substantially sacrificing pumping efficiency. Because the disparity between natural modal frequencies of diaphragm 26 is increased, actuators 28 may be actuated or "fired" at a faster frequency without corresponding trajectory or other fluid ejection errors that otherwise might exist due to the natural modal frequency disparity being too close to the firing frequency.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A print head comprising:

one or more structures having a floor, a first end and a second opposite end, the floor, the first end and the second opposite end at least partially forming a fluid chamber;

a nozzle opening through the first end in communication with the fluid chamber;

a diaphragm opposite the floor and across the fluid chamber;

an actuator connected to the diaphragm to move the diaphragm towards the floor; and a first support extending from the floor to the diaphragm between the first end and the second end.

2. The print head of claim 1, wherein the fluid chamber extends completely about the first support.

3. The print head of claim 1, wherein the first support has an oval cross-section.

4. The print head of claim 1, wherein the print head further comprises a second support extending from the floor to the diaphragm between the first support and the second end.

5. The print head of claim 4, wherein the actuator is between the first support and the second support.

6. The print head of claim 5, wherein the actuator is a piezo electric actuator.

7. The print head of claim 1, wherein the fluid chamber has a first transverse side and a second transverse side and wherein at least one of the first support and the second support extends from one of the first transverse side and the second transverse side of the fluid chamber.

8. The print head of claim 1, wherein the fluid chamber has a first transverse side and a second transverse side and wherein at least one of the first support and the second support is spaced from the first transverse side and the second transverse side of the fluid chamber.

9. The print head of claim 1, wherein the first support is integrally form as a single unitary body with the floor.

10. The print head of claim 1, wherein the actuator is a piezo electric actuator.

11. The print head of claim 1, wherein the first support crosses a longitudinal end of the actuator.

12. The print head of claim 11, wherein the actuator comprises a piezo electric layer and wherein the first support crosses a longitudinal end of the piezo electric layer.

13. The print head of claim 1, wherein the diaphragm is bonded to the first support.

14. The print head of claim 1, wherein the first support and the one or more structures comprise silicon.

15. A method comprising:

providing a chamber and a diaphragm over at least a portion of the chamber and supported by a first support; and actuating the diaphragm to move fluid within the chamber past the first support and through a side opening of the chamber, wherein passing the fluid past the first support comprises passing the fluid around opposite sides of the first support.

16. A method comprising:

providing a chamber and a diaphragm over at least a portion of the chamber and supported by a first support; and actuating the diaphragm to move fluid within the chamber past the first support and through a side opening of the chamber, wherein of the diaphragm is supported by a second support and wherein the method further comprises passing fluid past the second support towards the first support.

17. The method of claim 16, wherein passing fluid past the second support comprises passing the fluid around opposite sides of the second support.

18. A print head comprising:

one or more structures having a floor, a first side and a second opposite side, the floor, the first side and the second opposite side at least partially forming a fluid chamber;

a nozzle opening through the first side in communication with the fluid chamber;

a diaphragm opposite the floor and across the fluid chamber; and means for supporting a first longitudinal end of the diaphragm between transverse sides of the diaphragm and spaced from a proximate first end of the fluid chamber.

19. The print head of claim 18 further comprising means for supporting a second longitudinal end of the diaphragm between transverse sides of the diaphragm and spaced from a proximate second end of the fluid chamber.

* * * * *